US006560432B1

(12) United States Patent
Longhenry et al.

(10) Patent No.: US 6,560,432 B1
(45) Date of Patent: May 6, 2003

(54) ALLOYED DONOR ROLL COATING

(75) Inventors: Joy L. Longhenry, Webster, NY (US); Michelle L. Schlafer, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/012,771

(22) Filed: Nov. 5, 2001

(51) Int. Cl.[7] ..... G03G 15/08
(52) U.S. Cl. ..... 399/286
(58) Field of Search ..... 399/279, 286; 492/18, 28, 48, 53, 56, 58, 59; 118/653, 654, 647; 418/323, 329; 75/10.19, 10.21, 10.26

(56) References Cited

U.S. PATENT DOCUMENTS

| | | | | |
|---|---|---|---|---|
| 5,122,182 A | * | 6/1992 | Dorfman et al. | 428/323 X |
| 5,244,727 A | * | 9/1993 | Shibata et al. | 428/329 |
| 5,473,418 A | | 12/1995 | Kazakos et al. | 399/284 |
| 5,600,414 A | | 2/1997 | Hyllberg | 399/176 |

* cited by examiner

*Primary Examiner*—Hoan Tran
(74) *Attorney, Agent, or Firm*—Perman & Green, LLP

(57) ABSTRACT

A toner donor roll for use in a development apparatus of an electrophotographic apparatus is disclosed. The donor roll includes a conductive core of a ceramic outer coating over the conductive core, the ceramic coating formed from thermal spraying a single homogeneous powder consisting of particles each of which contains a specific ratio of pure alumina and pure titania held together with an organic binder.

8 Claims, 3 Drawing Sheets

ALLOYED DONOR ROLL COATING

BACKGROUND OF THE INVENTION

1. Field of the Invention

The present invention relates to a development apparatus used in electrostatographic printing machines, and more specifically, the present invention relates to a particular material composition for a ceramic coated donor roll for use in a hybrid scavengeless or hybrid jumping development apparatus.

2. Description of the Prior Art

Generally, the process of electrostatographic reproduction includes uniformly charging a photoconductive member, or photoreceptor, to a substantially uniform potential, and then imagewise discharging it or imagewise exposing it to light reflected from an original image that is being reproduced. The result is an electrostatically formed latent image on the photoconductive member. The latent image that is formed is developed by bringing a charged developer material into contact with the latent image. Two component and single-component developer materials are commonly used. A typical two-component developer material comprises magnetic carrier particles, having charged toner particles adhering triboelectrically thereto. A single component developer material typically comprises charged toner particles only. In either case, the charged toner particles when brought into contact with the latent image, are attracted to such image, thus forming a toner image on the photoconductive member. The toner image is subsequently transferred to a receiver sheet which is then passed through a fuser apparatus where the toner image is heated and permanently fused to the sheet, thus forming a hard copy of the original image.

To develop a latent image in an electrostatographic reproduction machine as described above, charged toner particles either alone (single component), or mixed (two-component), are brought, by a development apparatus, into contact with the latent image formed on the photoreceptor. For two-component development, developer material containing carrier particles and toner particles is used. The development apparatus for such development typically includes a housing defining a chamber within which the developer material is mixed and charged. Moving and mixing two-component developer material triboelectrically and oppositely charges the carrier particles and the toner particles causing the toner particles to adhere to the carrier particles.

As disclosed for example in U.S. Pat. No. 5,245,392, and U.S. Ser. No. 07/091,858 both assigned to the assignee of the present application, one type of a two-component development method and apparatus is referred to as "hybrid scavengeless development", and is very suitable for image-on-image development type processes. The apparatus includes a housing defining a development zone, and a mixing chamber holding developer material containing carrier and toner particles. The apparatus also includes a magnetic roll and a donor member such as a donor roll for receiving charged toner particles from the magnetic roll and transporting them to the development zone. A plurality of electrode wires are embedded in, or are closely spaced relative to, the donor roll within the development zone. An AC voltage is applied to the electrode wires for forming a toner cloud in the development zone. Electrostatic fields generated by an adjacent latent image on a photoreceptor surface serve to attract charged toner particles from the toner cloud, thus developing the latent image.

Single component development systems, referred to as jumping gap development, can also use a donor roll for transporting charged toner particles directly from a toner chamber to the development zone. The charged toner particles similarly are attracted by and develop an electrostatic latent image recorded on a photoconductive surface. In jumping gap development, an AC voltage is applied to the donor roll for detaching toner particles from the donor roll and projecting them toward an adjacent photoconductive surface holding the electrostatic latent image.

In either of the above discussed development systems for example, the donor member or roll and its electrical and chemical characteristics are very important to the ability of the development apparatus repeatably transport acceptable and uniform quantities of toner particles into the development zone, as well as effectively support the electrostatic fields necessary within the development zone for high quality image development. For example, the donor roll must be suitable for charged toner particles to effectively and controllably (even at high speeds) adhere electrostatically thereto. The surface of the donor roll must be partially conductive relative to a more conductive core, and this partial conductivity on the surface should be uniform throughout the entire circumferential surface area. The range of conductivity of a donor roll should be well chosen in order to maximize the efficiency of a donor roll in view of any number of designed parameters, such as energy consumption, mechanical control and the discharge time-constant of the surface thereof.

In image-on-image type processes with a pre-developed toner image already on the photoreceptor, the donor roll should also act as an electrostatic "intermediate" between the photoreceptor and the developer transport roll in order to minimize unwanted interactions between the development system and the photoreceptor. Minimizing such interactions is particularly desirable in such processes because the single photoreceptor therein is to be charged, exposed and developed several times usually in a single, as in single pass highlight color process or in a single pass color process.

The donor roll must further have desirable wear-resistant properties so that the surface thereof will not be readily abraded by adjacent surfaces. Further, the surface of the donor should be without anomalies such as pin holes, which may be created in the course of its manufacture. Pinholes created in the manufacturing process or abrasions caused in its use, can result in electrostatic "hot spots" and undesirable electrical arcing in the vicinity of such structural imperfections. Ultimately, the most important requirement of the donor roll can be summarized by the phrase "uniform conductivity;" Other physical properties of the donor/roll, such as the mechanical adhesion of toner particles, are also important, but are generally not as quantifiable in designing development apparatus.

Known coating materials for donor rolls basically consist of a mechanical blend of two different starting ceramic powders, each consisting of varying levels of, for example, alumina and titania. These two starting powders are mechanically blended in a specific ratio to achieve the desired percent of alumina and titania. This process requires weighing the two starting powders to achieve the correct ratio, and then blending the two powders together to achieve a homogenous mixture. An error in weighing results in a donor roll coating that does not meet its electrical property specification.

Examples of these alumina-titania coating material blends are described in U.S. Pat. Nos. 5,473,418 and 5,600,414.

SUMMARY OF THE INVENTION

In accordance with features of the disclosed embodiments presented herein, a toner donor roll for use in a development apparatus, comprises a conductive core; and a ceramic outer coating over the conductive core, the ceramic coating being formed from thermal spraying a single homogeneous powder consisting of particles each of which contains a specific ratio of pure alumina and pure titania held together with an organic binder.

In accordance with still other features of the disclosed embodiments described herein an apparatus for developing a latent electrostatic image on a surface comprises a housing defining a chamber storing developer material containing toner particles; means mounted partially within the chamber for moving the developer material; and at least one rotatable donor roll for transporting toner particles into a development transfer relationship with the latent electrostatic image on the surface, the donor roll being mounted in a toner particle receiving relationship with the developer material moving means, the donor roll including a core, and a ceramic outer coating, the ceramic coating formed from thermal spraying a single homogeneous powder consisting of particles each of which contains a specific ratio of pure alumina and pure titania held together with an organic binder.

In accordance with still other features of the disclosed embodiments a printing machine comprises an image bearing surface; means for electrostatically forming a latent image on the image bearing surface; and a development apparatus for developing the latent electrostatic image, the development apparatus including: a housing defining a chamber storing developer material containing toner particles; means mounted partially within said chamber for moving the developer material; and at least one rotatable donor roll for transporting toner particles into a development transfer relationship with the latent electrostatic image on the image bearing surface, the donor roll being mounted in a toner particle receiving relationship with the developer material moving means, the donor roll including a core, and a ceramic outer coating, the ceramic outer coating formed from thermal spraying a single homogeneous powder consisting of particles each of which contains a specific ratio of pure alumina and pure titania held together with an organic binder.

BRIEF DESCRIPTION OF THE DRAWINGS

Other features of the embodiments described herein will become apparent as the following description precedes and upon reference to the drawings, in which.

While the present invention will be described in connection with preferred embodiments as described herein, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Inasmuch as the art of electrostatographic reproduction is well known, the various processing stations employed in an exemplary electrostatographic reproduction machine will be shown hereinafter schematically, and their operations described only briefly.

Figure 1:
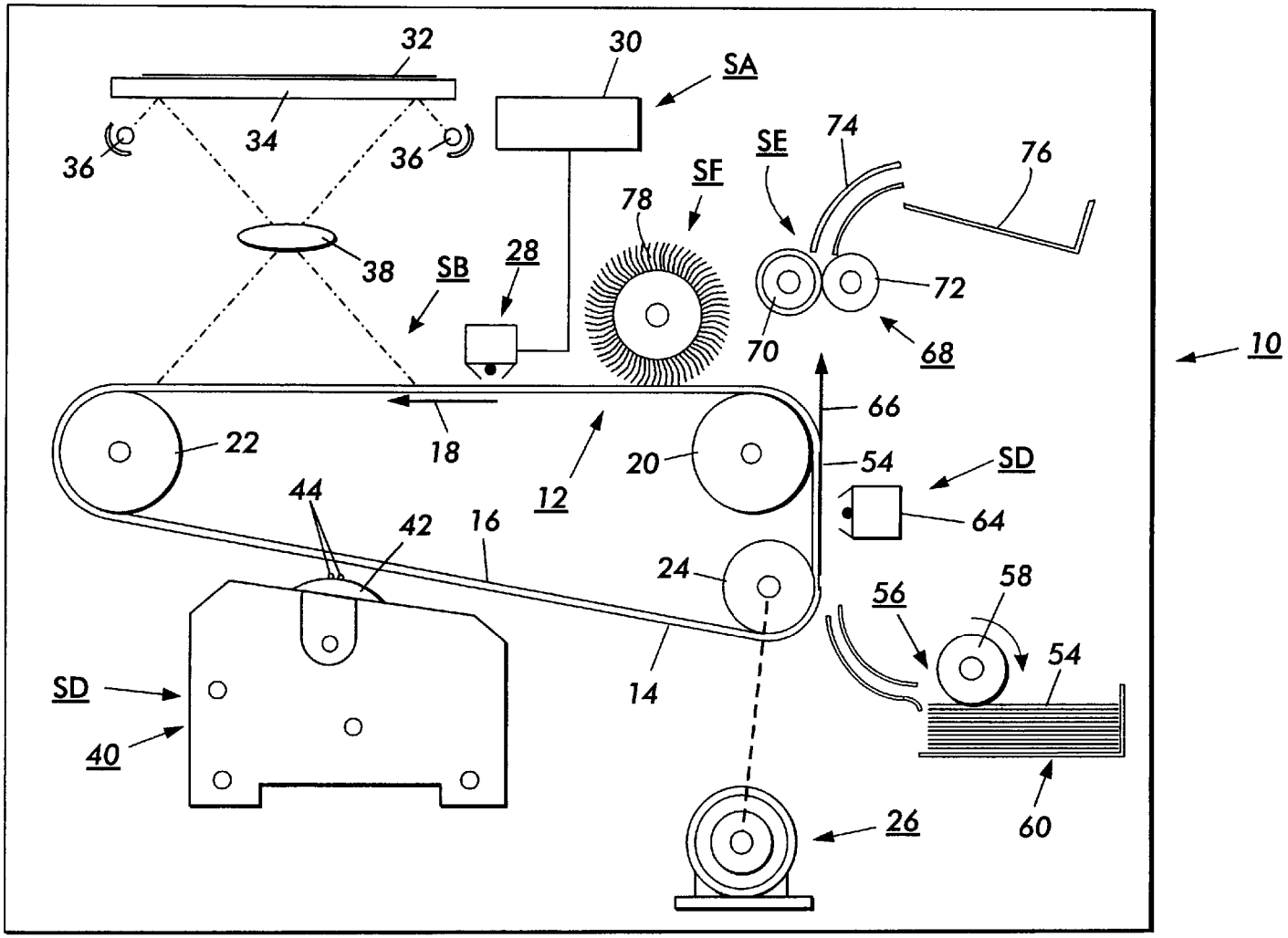
FIG. 1 is a schematic plan elevational view of an illustrative image-on-image electrostatographic printing machine incorporating a development apparatus according to the embodiments described herein.

Referring initially to FIG. 1, there is shown an exemplary electrostatographic printing machine 10 incorporating the development apparatus as described herein. The electrostatographic printing machine 10, for example, employs a belt type image bearing member 12 having a photoconductive surface 14 formed over an electrically grounded conductive substrate 16. One skilled in the art, however, will appreciate that another suitable arrangement of a photoconductive image bearing member, such as a drum having a photoconductive surface, may be used. As shown, belt 12 moves in the direction of arrow 18 to advance successive portions of photoconductive surface 14 sequentially through the various processing stations disposed about the path of movement thereof. Belt 12 is entrained about stripping roller 20, tensioning roller 22, and drive roller 24. Drive-roller 24 is mounted rotatably in engagement with belt 12. Motor 26 is coupled to, and rotates roller 24 in order to advance belt 12 in the direction of arrow 18. Belt 12 is maintained in tension by a suitable pair of springs (not shown) resiliently urging tensioning roller 22 against belt 12 with a desired spring force. Stripping finger 20 and tensioning roller 22 are mounted to rotate freely.

Initially, a portion of belt 12 passes through charging station SA where a corona generating device, indicated generally by the reference numeral 28, charges photoconductive surface 14 to a relatively high, and substantially uniform potential. High voltage power supply 30 is coupled to corona generating device 28, and excitation of the power supply 30 causes corona generating device 28 to charge a portion of the photoconductive surface 14 of belt 12. After such charging, the charged portion is advanced, as belt 12 is moved, to exposure station SB.

At exposure station SB, lamps 36 flash light rays for reflection onto an original document 32 that is placed face down upon a transparent platen 34. The light rays reflected imagewise from the original image of document 32 are transmitted through lens 38 to form a light image thereof. Lens 38 focuses the imagewise light rays onto the charged portion of photoconductive surface 14 at exposure station SB and thus selectively dissipates the charge thereon to form a latent image. The latent image thus formed on photoconductive surface 14 corresponds to the informational areas contained within the original image of document 32. For such image wise exposure of photoconductive surface 14, a raster output scanner (ROS) (not shown) may alternatively be used in lieu of the lamps and light lens system previously described. As is well known, the ROS can be used as such to layout an image in a series of horizontal scan lines with each line having a specified number of pixels per inch.

After the electrostatic latent image has been formed thus on photoconductive surface 14, belt 12 advances the latent image to development station SC. At development station SC, the development apparatus according to the embodiments described herein, indicated generally by the reference numeral 40, (to be described in detail below) develops the latent image recorded on the photoconductive surface 14 to form a toner image. Belt 12 then advances the toner image to transfer station SD where a copy sheet 54 is advanced by sheet feeding apparatus 56 into a transfer relation with the toner image. Preferably, sheet feeding apparatus 56 includes a feed roll 58 contacting the uppermost sheet of a stack 60 of such sheets. Transfer station SD also includes a corona generating device 64 which sprays ions onto the back side of sheet 54 to attract the toner image from photoconductive surface 14 onto sheet 54. After such image transfer, sheet 54 is separated from the belt 12 and moved in the direction of arrow 66 onto a conveyor (not shown) which advances sheet 54 to fusing station SE.

As shown, fusing station SE includes a fuser assembly indicated generally by the reference numeral 68 that has a pair of fusing rolls. The fusing assembly rolls 68 preferably include a heated fuser roller 70 and a back-up pressure roller 72. Sheet 54 is passed between fuser roller 70 and back-up roller 72 so that the toner image thereon contacts heated fuser roller 70. In this manner, the toner image is heated, fused and permanently affixed to sheet 54 forming a sheet copy of the original image of document 32. The sheet copy now on sheet 54 is then advanced through a chute 74 to catch tray 76 for subsequent removal from the reproduction machine 10.

Meanwhile, belt 12 next moves the portion of the surface 14 from which the image had been transferred to the copy sheet 54 to a cleaning station SF where residual toner particles are cleaned or removed. Cleaning station SF, for example, includes a rotatably mounted fibrous brush 78 that rotates in contact with photoconductive surface 14 for cleaning by removing the residual toner particles. Subsequent to such cleaning, a discharge lamp (not shown) floods photoconductive surface 14 with light in order to dissipate any residual electrostatic charge remaining thereon from the prior imaging cycle.

Typically, the speed of such electrostatographic printing or reproduction machines is measured in terms of a number of sheet copies produced per unit time. Among different families of such machines, speed therefore varies significantly from a low between 10 and 20 copies per minute to a high of greater than 100 copies per minute. For such machines to produce high quality copies or reproductions of original images, the processing stations (including the development station SC), must be designed so as to function effectively at a desired speed of the machine. For example, the development station SC therefore must be capable of functioning as such, even at substantially high machine speeds, to repeatably deliver a uniform, desired quantity of toner particles to the development zone for latent image development.

It is believed that the foregoing description is sufficient for purposes of the present application to illustrate the general operation of an electrostatographic reproduction machine incorporating the development apparatus as described herein.

Figure 2:
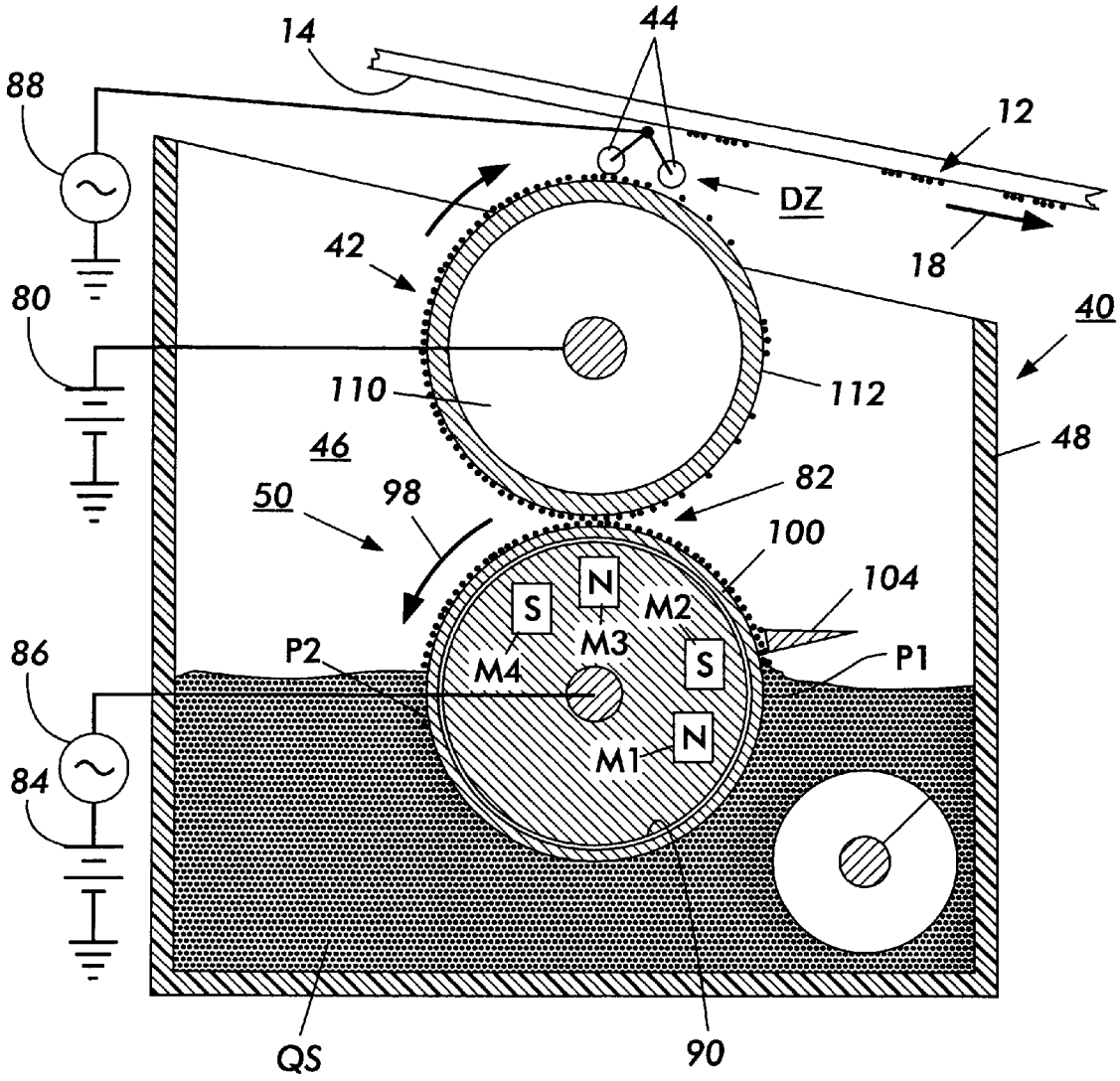
FIG. 2 is a schematic elevational view of an embodiment of a two component development apparatus including the donor roll according to the present invention.

Referring now to FIG. 2, there is shown a two-component embodiment of the development apparatus 40. The development apparatus 40 includes the improved donor roll 42 according to the embodiments described herein for enabling an effective and repeatable delivery of a uniform, desired quantity of toner particles for latent image development. As shown, development apparatus 40 includes the movable donor roll 42 (to be described in detail below) that is mounted, at least partially, within a mixing chamber 46. Although not illustrated, a development apparatus could have multiple donor rolls. Mixing chamber 46 is defined by housing 48, and holds a supply QS of developer material consisting of toner particles and carrier beads. The donor member 42 is moved to transport toner particles fed from the chamber 46 into contact with cloud producing electrode wires 44 within the development zone DZ for latent image development. The developer material QS typically is a two-component developer material comprising at least magnetizable carrier beads and the toner particles. As is well known, the developer material QS is moved and mixed within the mixing chamber 46 by a mixing device such as an auger (not shown) in order to oppositely and triboelectrically charge such carrier beads and toner particles respectively. As a consequence of such charging, the oppositely charged toner particles adhere triboelectrically to the charged magnetizable carrier beads.

The development apparatus 40 also includes a developer material feeder assembly such as a magnetic roll 50 for feeding a quantity QF of developer material from the chamber 46 to the donor roll 42. The feeder assembly 50 includes a cylindrical substrate or shell 90 that can be made out of a general purpose polycarbonate. The shell 90 is rotatable in the direction of the arrow 98, and includes a coating 100 thereover, as well as magnetic members M1 to M4 within its core. The magnetic roller 50 and the donor roll 42 are electrically biased relative to each other so that charged toner particles within the quantity QF of developer material fed to the donor roll 42 are attracted from the magnetic roll 50 to donor roll 42.

As further shown in FIG. 2, the donor roll 42 is biased to a specific voltage, by a DC power supply 80 in order to enable donor roll 42 to attract charged toner particles off of magnetic roll 50 in a nip 82. To enhance the attraction of charged toner particles from the chamber 46, magnetic roll 50 is also biased by a DC voltage source 84. It is also biased by a AC voltage source 86 that functions to temporarily loosen the charged toner particles thereon from their adhesive and triboelectric bonds to the charged, magnetized carrier beads. Loosened as such, they can be attracted more easily to the donor roll 42. AC voltage source 86 can be applied either to a conductive layer of the magnetic roll 50 as shown in FIG. 2 or directly to the donor roll in series with the DC supply 80. Similarly as shown, an AC bias is also applied to the electrode wires 44 by an AC voltage source 88 and serves to loosen charged toner particles from the donor member 42, as well as to form a toner cloud within the development zone DZ.

Figure 3:
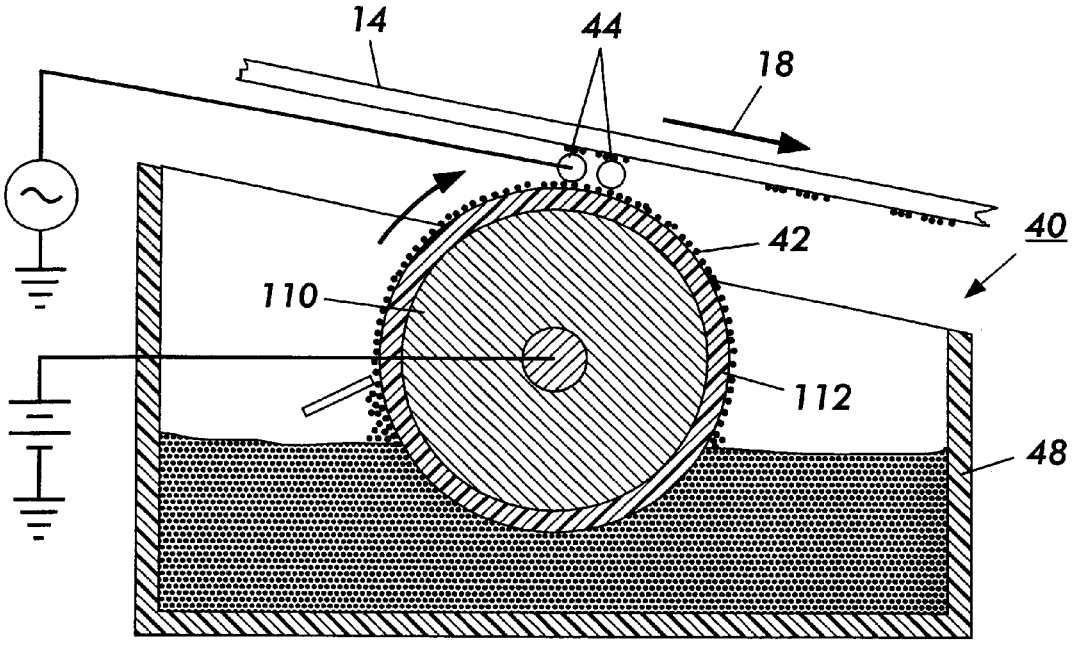
FIG. 3 is a schematic elevational view of an embodiment of a single component development apparatus including the donor roll according to the present invention.

Referring now to FIG. 3, a single-component embodiment of the development 40 is illustrated. In FIGS. 2 and 3, like reference numerals indicate like elements. As in the two component system of FIG. 2, the single-component system includes a donor roll 42 (to be described in detail below) and biased electrode wires 44. In the single component version, the donor roll 42 picks up toner particles directly from a supply of such toner particles held in a toner chamber defined by the housing 48. The donor roll 42 as shown then transports the toner particles to the development zone DZ for latent image development. In the single-component system of FIG. 3 there is therefore no developer material feeder since no carrier beads are used in the system.

Now referring to either FIGS. 2 or 3, the donor roll 42 includes a core 110 consisting of a conventional conductive material, such as aluminum, and an outer surface coating 112 that is made of a particular advantageous ceramic compound or composition (to be described in detail below). The use of a donor roll of this type coated with a ceramic compound is disclosed for example in U.S. Pat. No. 5,322,970 issued Jun. 21, 1994, to Behe et al. and commonly assigned to the assignee of this application. The contents and disclosure of U.S. Pat. No. 5,322,970 are hereby fully incorporated in this application. This ceramic surface coating 112 is preferably thermally sprayed, e.g. by plasma spraying onto the core 110 of donor roll 42 so as to achieve required electrical properties, as well as a thickness suitable for desired conductivity, and breakdown voltage protection. However, it is to be noted that even though plasma spraying is the preferred thermal spraying process, other thermal spray processes may be used for spraying onto the core.

Plasma spraying as a preferred thermal spraying process generates a plasma by passing an inert gas through a high voltage electric arc. The ionized gas is forced through a nozzle where powder is introduced into the plasma stream. The powder melts and is projected at high velocities onto a substrate. Depending on the particular substrate used it may be necessary to cool the samples with air jets during the plasma spray process.

The thickness of the ceramic coating 112, for example, is preferably between 0.17 and 0.5 mm, on a donor roll 42 having a total outer diameter of approximately 31 mm. Because in plasma spraying the ceramic coating 112 can be controlled precisely, it can thus be controlled in order to ensure that surface anomalies such as craters or pin holes are kept to a minimum. A donor having a ceramic coating surface also has shown no significant abrasion problems when used for an extended period of time in a development apparatus within moving contact with a developer feeder device and toner materials.

Ceramic coated donor rolls can have electrical resistivity of about $10^3$ ohm-cm to $10^{10}$ ohm-cm. In some exemplary embodiments of the donor roll, the preferred coating has an electrical resistivity of $10^8$ ohm-cm. The use of such a donor roll in a continuous-process electrostatographic development apparatus is therefore preferable since the apparatus involves a frequent and relatively high speed charging and discharging development function.

A ceramic is a non-metallic, inorganic compound normally comprised of a blend of any of a number of materials including for example the following: alumina, zirconia, thoria, beryllia, magnesia, spinel, silica, titania, and forsterite.

It has been found that particular combinations consisting essentially of alumina and titantia are sufficient to produce a plasma sprayed coating on an aluminum core donor roll that satisfies the resistivity, dielectric constant, and discharge time constant requirements of the development apparatus of the embodiments described herein. Current coating materials for donor rolls consist of a mechanical blend of two different starting powders each consisting of varying levels of alumina and titania. In a particular embodiment these two starting powders are mixed in a specific ratio to achieve 22% titania ($T_iO_2$) by a process that requires weighing the two starting powders to achieve the correct ratio and then blending the two powders together to achieve a homogenous mixture. This blended powder is then plasma sprayed to form the donor roll ceramic layer. Any error in weighing will result in a donor roll coating that does not meet its electrical property specification. A new powder available through Praxair Surface Technologies located in Indianapolis, Ind. eliminates the need to weigh two starting powders and, therefore, eliminates the risk of mixing an incorrect ratio.

In currently used mixed alumina/titania coatings for donor rolls, the ceramic layer is formed by plasma spraying a mechanical or physical blend that is composed of two ceramic starting powders each of which contains alumina and titania at varying levels. The first ceramic material of the starting powders consists of a mixture of alumina and titania particles that are fused together prior to plasma spraying. The second ceramic material of the starting powders consists of a mixture of alumina and titania particles that are also fused together prior to plasma spraying. These first and second ceramic materials, each of which contain alumina and titania, are then mechanically blended or mixed in a specific weight ratio to achieve the desired titania level and this blended mixture is what is plasma sprayed to form the ceramic coating layer. Thus, two materials, both of which contain alumina and titania, are used to create the final composition of alumina and titania.

In accordance with the features of the embodiments described herein there is used a single powder, i.e., it is neither a mechanical blend of two starting powders each containing both alumina and titania nor are its components fused together prior to plasma spraying. Instead, the material that is thermally sprayed to form the ceramic coating layer is a single powder consisting of pure alumina (i.e., a powder containing pure alumina and substantially no titania) and pure titania (i.e., a powder containing pure titania and substantially no alumina) particles that are held together by an organic binder.

The single powder is manufactured by Praxair Surface Technologies. It contains particles that are agglomerates of pure alumina and pure titania and is not a mechanical blend of two starting powders both of which contain alumina and titania nor is it fuses together before thermal spraying. An example of such a single powder consists of about 22% titania and about ~77% alumina, with the remaining composition essentially consisting of the organic binder (The powder can also have a very small amount of impurities). Various organic binders can be used. Examples of organic binder materials include polyvinylalcohol and polymethylmethacrylate. This single powder is manufactured by taking pure alumina powder and pure titania powder, dispersing them in water along with the binder, and spray-drying the powder. The final powder product consists of a homogenous of particles with the particles containing 22% titania, 77% alumina and organic binder that holds the particles together. The present invention is not limited to a composition with 22% titania. Other compositions may also be used. In any event, the binder then is burned off in the intense heat during the plasma spray process. Thus, the final powder product that is plasma sprayed or thermal sprayed does not consist of two starting powders both containing alumina and titania that are blended nor does the final powder product contain alumina and titania particles that were fused together.

This single powder was sprayed and tested using a closed-loop plasma spray system. Donor rolls were then processed in the same manner as the current donor roll coatings as described in U.S. patent application Ser. No. 09/503,937 filed Feb. 14, 2000 for "Donor Rolls and Methods of Making Donor Rolls" also assigned to the Xerox Corporation, the contents of which are incorporated herein by reference.

The clear advantages of using a single powder as opposed to blending two powders are: (1) reduced cost in production due to elimination of weighing and mixing process steps, and (2) reduces scrap from the electrical property specification due to incorrect weighing.

The donor roll in accordance with the features of the present invention includes a ceramic coating that comprises from about 10% to about 40% titania, and about 60% to about 90% alumina, by weight. A specific example would be a donor roll having a ceramic coating comprising about 22% titania and about 77% alumina, by weight.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A toner donor roll for use in a development apparatus in an electrophotographic apparatus, the donor roll comprising:

(a) a conductive core; and (b) a ceramic outer coating over the conductive core, the ceramic coating formed from thermal spraying a single homogeneous powder consisting of particles each of which contains a specific ratio of pure alumina and pure titania held together with an organic binder.

2. The toner donor roll of claim 1, wherein said thermal spraying is plasma spraying.

3. The toner donor roll of claim 1, wherein said ceramic coating comprises from about 10% to about 40% titania and about 60% to about 90% alumina, by weight.

4. The toner donor roll of claim 1, wherein said ceramic coating comprises about 22% titania and about 77% alumina, by weight.

5. The toner donor roll of claim 1, wherein said ceramic coating has an electrical resistivity of about $10^3$ ohm-cm to about $10^{10}$ ohm-cm.

6. The toner donor roll of claim 5, wherein said ceramic coating further comprises 1–2% by weight other oxides.

7. An apparatus for developing a latent electrostatic image on a surface, the apparatus comprising:

(a) a housing defining a chamber storing developer material containing toner particles;

(b) means mounted partially within the chamber for moving the developer material; and (c) at least one rotatable donor roll for transporting toner particles into a development transfer relationship with the latent electrostatic image on the surface, the donor roll being mounted in a toner particle receiving relationship with the developer material moving means, the donor roll including a core, and a ceramic outer coating, the ceramic coating formed from thermal spraying a single homogeneous powder consisting of particles each of which contains a specific ratio of pure alumina and pure titania held together with an organic binder.

8. A printing machine comprising:

(a) an image bearing surface;

(b) means for electrostatically forming a latent image on the image bearing surface; and (c) a development apparatus for developing the latent electrostatic image, the development apparatus including:

(i) a housing defining a chamber storing developer material containing toner particles;

(ii) means mounted partially within said chamber for moving the developer material; and (iii) at least one rotatable donor roll for transporting toner particles into a development transfer relationship with the latent electrostatic image on the image bearing surface, the donor roll being mounted in a toner particle receiving relationship with the developer material moving means, the donor roll including a core, and a ceramic outer coating, the ceramic outer coating formed from thermal spraying a single homogeneous powder consisting of particles each of which contains a specific ratio of pure alumina and pure titania held together with an organic binder.

* * * * *